US009713749B2

(12) United States Patent
Sullivan et al.

(10) Patent No.: US 9,713,749 B2
(45) **Date of Patent: *Jul. 25, 2017**

(54) MULTI-LAYER CORE GOLF BALL

(71) Applicant: Acushnet Company, Fairhaven, MA (US)

(72) Inventors: Michael J. Sullivan, Old Lyme, CT (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/193,241

(22) Filed: Jun. 27, 2016

(65) Prior Publication Data

US 2016/0303433 A1 Oct. 20, 2016

Related U.S. Application Data

(63) Continuation of application No. 14/485,866, filed on Sep. 15, 2014, which is a continuation of application No. 13/221,879, filed on Aug. 30, 2011, now Pat. No. 8,834,299, which is a continuation-in-part of application No. 12/629,594, filed on Dec. 2, 2009, now Pat. No. 8,123,631, which is a continuation-in-part of application No. 11/972,240, filed on Jan. 10, 2008, now Pat. No. 7,722,482, said application No. 13/221,879 is a continuation-in-part of application No. 13/184,943, filed on Jul. 18, 2011, now Pat. No. 8,231,482, which is a continuation of application No. 12/819,256, filed on Jun. 21, 2010, now Pat. No. 7,980,965, which is a continuation of application No. 11/972,259, filed on Jan. 10, 2008, now Pat. No. 7,753,810.

(51) Int. Cl.
*A63B 37/06* (2006.01)
*A63B 37/00* (2006.01)

(52) U.S. Cl.
CPC ..... *A63B 37/0092* (2013.01); *A63B 37/0003* (2013.01); *A63B 37/0043* (2013.01); *A63B 37/0045* (2013.01); *A63B 37/0062* (2013.01); *A63B 37/0063* (2013.01); *A63B 37/0064* (2013.01); *A63B 37/0076* (2013.01); *A63B 37/0031* (2013.01); *A63B 37/0033* (2013.01); *A63B 37/0035* (2013.01); *A63B 37/0047* (2013.01); *A63B 37/0065* (2013.01); *A63B 37/0066* (2013.01); *A63B 37/0087* (2013.01)

(58) Field of Classification Search
CPC ..... A63B 37/0062
USPC ..... 473/376
See application file for complete search history.

(56) References Cited

U.S. PATENT DOCUMENTS

| | | | |
|---|---|---|---|
| 2,998,977 | A | 9/1961 | Molitor |
| 4,650,193 | A | 3/1987 | Molitor et al. |
| 4,781,383 | A | 11/1988 | Kamada et al. |
| 4,858,924 | A | 8/1989 | Saito et al. |
| 5,002,281 | A | 3/1991 | Nakahara et al. |
| 5,033,748 | A | 7/1991 | Ebisuno |
| 5,048,838 | A | 9/1991 | Chikaraishi et al. |

(Continued)

*Primary Examiner* — Raeann Gorden
(74) *Attorney, Agent, or Firm* — Mandi B. Milbank

(57) ABSTRACT

Golf balls comprising a multi-layer core and a cover are disclosed. The multi-layer core comprises a zero or negative hardness gradient center that, optionally, is hard relative to an intermediate core layer.

9 Claims, 1 Drawing Sheet

(56) References Cited

U.S. PATENT DOCUMENTS

| | | | |
|---|---|---|---|
| 5,104,126 | A | 4/1992 | Gentiluomo |
| 5,314,187 | A | 5/1994 | Proudfit |
| 5,482,285 | A | 1/1996 | Yabuki et al. |
| 5,490,674 | A | 2/1996 | Hamada et al. |
| 5,733,206 | A | 3/1998 | Nesbitt et al. |
| 5,743,816 | A | 4/1998 | Ohsumi et al. |
| 5,772,531 | A | 6/1998 | Ohsumi et al. |
| 5,779,562 | A | 7/1998 | Melvin et al. |
| 5,976,443 | A | 11/1999 | Nesbitt et al. |
| 6,057,403 | A | 5/2000 | Sullivan et al. |
| 6,071,201 | A | 6/2000 | Maruko |
| 6,113,831 | A | 9/2000 | Nesbitt et al. |
| 6,213,895 | B1 | 4/2001 | Sullivan et al. |
| 6,245,859 | B1 | 6/2001 | Sullivan et al. |
| 6,277,034 | B1 | 8/2001 | Nesbitt et al. |
| 6,336,872 | B1 | 1/2002 | Moriyama et al. |
| 6,379,269 | B1 | 4/2002 | Nesbitt et al. |
| 6,394,912 | B1 | 5/2002 | Nakamura et al. |
| 6,406,383 | B2 | 6/2002 | Moriyama et al. |
| 6,431,998 | B1 | 8/2002 | Nakamura et al. |
| 6,432,342 | B1 | 8/2002 | Nesbitt et al. |
| 6,500,076 | B1 | 12/2002 | Morgan et al. |
| 6,569,036 | B1 | 5/2003 | Takemura et al. |
| 6,605,009 | B1 | 8/2003 | Nakamura et al. |
| 6,616,550 | B2 | 9/2003 | Nesbitt et al. |
| 6,626,770 | B2 | 9/2003 | Takemura et al. |
| 6,815,521 | B2 | 11/2004 | Iwami |
| 6,852,044 | B2 | 2/2005 | Sullivan et al. |
| 6,855,074 | B2 | 2/2005 | Kato |
| 6,913,548 | B2 | 7/2005 | Moriyama et al. |
| 6,916,254 | B2 | 7/2005 | Ladd et al. |
| 6,981,926 | B2 | 1/2006 | Sullivan et al. |
| 6,988,962 | B2 | 1/2006 | Sullivan et al. |
| 7,037,965 | B2 | 5/2006 | Sullivan et al. |
| 7,074,137 | B2 | 7/2006 | Sullivan et al. |
| 7,125,345 | B2 | 10/2006 | Sullivan et al. |
| 7,153,467 | B2 | 12/2006 | Brum et al. |
| 7,255,656 | B2 | 8/2007 | Sullivan et al. |
| 7,652,086 | B2 | 1/2010 | Sullivan et al. |
| 7,753,810 | B2 | 7/2010 | Sullivan et al. |
| 8,834,297 | B2 | 9/2014 | Sullivan et al. |
| 8,834,299 | B2 * | 9/2014 | Sullivan ..... A63B 37/0043 473/376 |
| 9,375,614 | B2 * | 6/2016 | Sullivan ..... A63B 37/0043 |

* cited by examiner

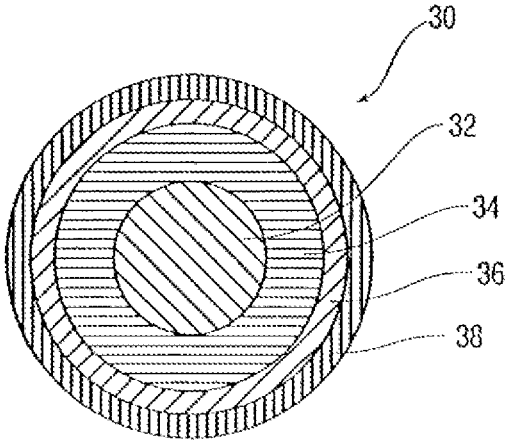
30
32
34
36
38

MULTI-LAYER CORE GOLF BALL

CROSS-REFERENCE TO RELATED APPLICATIONS

This application is a continuation of U.S. patent application Ser. No. 14/485,866, filed Sep. 15, 2014, which is a continuation of U.S. patent application Ser. No. 13/221,879, filed Aug. 30, 2011, now U.S. Pat. No. 8,834,299, which is a continuation-in-part of U.S. patent application Ser. No. 12/629,594, filed Dec. 2, 2009, now U.S. Pat. No. 8,123,631, which is a continuation-in-part of U.S. patent application Ser. No. 11/972,240, filed Jan. 10, 2008, now U.S. Pat. No. 7,722,482. U.S. patent application Ser. No. 13/221,879 is also a continuation-in-part of U.S. patent application Ser. No. 13/184,943, filed Jul. 18, 2011, now U.S. Pat. No. 8,231,482, which is a continuation of U.S. patent application Ser. No. 12/819,256, filed Jun. 21, 2010, now U.S. Pat. No. 7,980,965, which is a continuation of U.S. patent application Ser. No. 11/972,259, filed Jan. 10, 2008, now U.S. Pat. No. 7,753,810. The entire disclosure of each of these related applications is hereby incorporated herein by reference.

FIELD OF THE INVENTION

The present invention generally relates to golf balls, and more particularly to golf balls having multi-layer cores comprising a small center, an intermediate core layer, and an outer core layer, wherein the intermediate core layer is soft relative to the center.

BACKGROUND OF THE INVENTION

Golf balls having multi-layer cores are known. For example, U.S. Pat. No. 6,852,044 discloses golf balls having multi-layered cores having a relatively soft, low compression inner core surrounded by a relatively rigid outer core. U.S. Pat. No. 5,772,531 discloses a solid golf ball comprising a solid core having a three-layered structure composed of an inner layer, an intermediate layer, and an outer layer, and a cover for coating the solid core. U.S. Patent Application Publication No. 2006/0128904 also discloses multi-layer core golf balls. Other examples of multi-layer cores can be found, for example, in U.S. Pat. Nos. 6,071,201, 6,290,612, 6,336,872, 6,379,269, 6,394,912, 6,406,383, 6,431,998, 6,569,036, 6,605,009, 6,626,770, 6,815,521, 6,855,074, 6,913,548, 6,988,962, 7,153,467 and 7,255,656, and U.S. Patent Application Publication Nos. 2009/0181803, 2009/0181799, 2009/0181800, and 2009/0181804.

SUMMARY OF THE INVENTION

In one embodiment, the present invention is directed to a golf ball comprising a core and a cover. The core has an overall diameter of from 1.40 inches to 1.62 inches and comprises a center, an intermediate core layer, and an outer core layer. The center has a diameter of from 0.100 inches to 0.950 inches, a center Shore C hardness ($H_{center}$) of 75 or greater, and an outer surface Shore C hardness ($H_{center\ surface}$) of 70 or greater. The outer surface Shore C hardness of the center is less than or equal to the Shore C hardness of the geometric center. The intermediate core layer has an outer surface Shore C hardness ($H_{intermediate}$) of 85 or less. The outer core layer has an outer surface Shore C hardness ($H_{outer\ core}$) of 70 or greater. The outer surface Shore C hardness of the intermediate core layer is less than the outer surface Shore C hardness of the center. The overall core has a hardness gradient such that $H_{outer\ core}$ minus $H_{center}$ is less than or equal to 20.

In another embodiment, the present invention is directed to a golf ball comprising a core and a cover. The core has an overall diameter of from 1.40 inches to 1.62 inches and comprises a center, an intermediate core layer, and an outer core layer. The center has a diameter of from 0.100 inches to 0.950 inches, a center Shore C hardness ($H_{center}$) of from 30 to 95, and an outer surface Shore C hardness ($H_{center\ surface}$) of 20 or greater. The outer surface Shore C hardness of the center is less than or equal to the Shore C hardness of the geometric center. The intermediate core layer has an outer surface Shore C hardness ($H_{intermediate}$) of 75 or less. The outer core layer has an outer surface Shore C hardness ($H_{outer\ core}$) of from 40 to 95. The overall core has a hardness gradient such that $H_{outer\ core}$ minus $H_{center}$ is from 1 to 35. In a particular aspect of this embodiment, the outer surface Shore C hardness of the intermediate core layer is less than the outer surface Shore C hardness of the center.

BRIEF DESCRIPTION OF THE DRAWINGS

FIG. 1 is a cross-sectional view of a golf ball according to one embodiment of the present invention.

DETAILED DESCRIPTION

FIG. 1 shows a golf ball 30 according to one embodiment of the present invention, including a center 32, an intermediate core layer 34, an outer core layer 36, and a cover 38. While shown in FIG. 1 as a single layer, cover 38 may be a single-, dual-, or multi-layer cover.

A golf ball having a multi-layer core and a cover enclosing the core is disclosed. The multi-layer core comprises a center, an intermediate core layer, and an outer core layer. The overall diameter of the multi-layer core, also referred to herein as the outside diameter of the outer core layer, is 1.000 inches or greater, or 1.100 inches or greater, or 1.300 inches or greater, or 1.400 inches or greater, or is within a range having a lower limit of 1.000 or 1.300 or 1.400 or 1.450 or 1.500 or 1.580 or 1.600 or 1.610 or 1.620 inches and an upper limit of 1.500 or 1.550 or 1.580 or 1.600 or 1.610 or 1.620 or 1.630 or 1.640 or 1.650 or 1.660 inches, wherein the upper limit is greater than the lower limit (e.g., when the lower limit is 1.610 inches, the upper limit is 1.620, 1.630, 1.640, 1.650, or 1.660 inches). In a particular embodiment, the multi-layer core has an overall diameter of 1.450 inches or 1.500 inches or 1.510 inches or 1.530 inches or 1.550 inches or 1.570 inches or 1.580 inches or 1.590 inches or 1.600 inches or 1.610 inches or 1.620 inches. In another particular embodiment, the multi-layer core has an overall diameter of 1.400 inches or greater, or 1.450 inches or greater, or 1.500 inches or greater, or 1.550 inches or greater, or 1.600 inches or greater.

The center has a diameter of 0.100 inches or greater, or 0.125 inches or greater, or 0.150 inches or greater, or 0.200 inches or greater, or 0.250 inches or greater, or 0.500 inches or greater, or 0.750 inches or greater, or 1.000 inches or greater, or 1.250 inches or greater, or 1.300 inches or greater, or 1.350 inches or greater, or 1.400 inches or greater, or 1.425 inches or greater, or 1.450 inches or greater. In a particular embodiment, the center has a diameter within a range having a lower limit of 0.100 or 0.125 or 0.150 or 0.175 or 0.200 or 0.250 or 0.500 or 0.750 or 1.000 or 1.250 or 1.300 or 1.325 or 1.350 or 1.390 or 1.400 or 1.440 or 1.450 inches and an upper limit of 1.450 or 1.460 or 1.475 or 1.490 or 1.500 or 1.520 or 1.550 or 1.580 or 1.600 inches. In another particular embodiment, the center has a diameter within a range having a lower limit of 0.100 or 0.125 or 0.150 or 0.175 or 0.200 or 0.250 or 0.500 or 0.550 or 0.600 or 0.650 inches and an upper limit of 0.675 or 0.700 or 0.725 or 0.750 or 0.800 or 0.825 or 0.875 or 0.900 or 0.950 or 1.000 inches.

In a particular embodiment, the center has a center Shore C hardness ($H_{center}$) of 95 or less, or 90 or less, or 85 or less, or 80 or less, or 75 or less, or 70 or less, or a center Shore C hardness ($H_{center}$) within a range having a lower limit of 20 or 25 or 30 or 35 or 40 or 45 or 50 or 55 or 60 or 65 or 70 or 72 or 75 or 80 or 85 and an upper limit of 60 or 65 or 68 or 70 or 72 or 75 or 80 or 83 or 85 or 90 or 95, wherein the upper limit is greater than the lower limit (e.g., when the lower limit is 65, the upper limit is 68, 70, 72, 75, 80, 83, 85, 90, or 95). In another particular embodiment, the center has a center Shore C hardness ($H_{center}$) of 60 or greater, or 65 or greater, or 70 or greater, or 75 or greater, or 80 or greater, or 85 or greater, or 90 or greater, or 95 or greater, or a center Shore C hardness ($H_{center}$) within a range having a lower limit of 55 or 60 or 65 or 70 or 75 or 80 or 85 or 90 or 95 and an upper limit of 90 or 95 or 97 or 98, wherein the upper limit is greater than the lower limit (e.g., when the lower limit is 95, the upper limit is 97 or 98).

The center has an outer surface Shore C hardness ($H_{center\ surface}$) of 20 or greater, or 30 or greater, or 40 or greater, or 50 or greater, or 55 or greater, or 60 or greater, or 65 or greater, or 70 or greater, or 75 or greater, or 80 or greater, or 85 or greater, or 90 or greater. In a particular embodiment, the center has an outer surface Shore C hardness ($H_{center\ surface}$), within a range having a lower limit of 20 or 25 or 30 or 35 or 40 or 45 or 50 or 55 or 60 or 65 or 70 or 74 and an upper limit of 60 or 65 or 70 or 74 or 75 or 78 or 80 or 85 or 90 or 95, wherein the upper limit is greater than the lower limit (e.g., when the lower limit is 65, the upper limit is 70, 74, 75, 78, 80, 85, 90, or 95). In another particular embodiment, the center has an outer surface Shore C hardness ($H_{center\ surface}$) within a range having a lower limit of 50 or 55 or 60 or 65 or 70 or 75 or 80 or 85 or 90 and an upper limit of 80 or 85 or 90 or 95, wherein the upper limit is greater than the lower limit (e.g., when the lower limit is 85, the upper limit is 90 or 95).

The center has a negative hardness gradient, a zero hardness gradient, or a positive hardness gradient of up to 45 Shore C. In a particular embodiment, the center has a zero hardness gradient, such that $H_{center}=H_{center\ surface}$. In a particular aspect of this embodiment, the center is formed from a zero gradient formulation as disclosed, for example, in U.S. Pat. Nos. 7,537,530 and 7,537,529, the entire disclosures of which are hereby incorporated herein by reference. In another particular embodiment, the center has a negative hardness gradient, such that $H_{center\ surface}<H_{center}$. In a particular aspect of this embodiment, the value of $H_{center\ surface}$ minus $H_{center}$ is within a range having a lower limit of −1 or −3 or −5 or −7 or −10 or −13 and an upper limit of −13 or −15 or −20 or −25 or −30 or −33 or −35. Negative hardness gradient cores are more fully disclosed, for example, in U.S. Pat. Nos. 7,410,429, 7,537,529, and 7,537,530, the entire disclosures of which are hereby incorporated herein by reference. In another particular embodiment, the center has a positive hardness gradient, such that $H_{center\ surface}>H_{center}$. In a particular aspect of this embodiment, the value of $H_{center\ surface}$ minus $H_{center}$ is ≥1 or ≥3 or ≥5 or ≥6 or ≥8 or ≥10 or ≥13 or ≥15 or is within a range having a lower limit of 1 or 3 or 5 or 6 or 8 or 10 or 13 or 15 and an upper limit of 13 or 15 or 20 or 25 or 30 or 35 or 40, wherein the upper limit is greater than the lower limit (e.g., when the lower limit is 15, the upper limit is 20, 25, 30, 35, or 40). In another particular embodiment, the center has a zero or negative hardness gradient, such that $H_{center\ surface}\leq H_{center}$. In a particular aspect of this embodiment, the value of $H_{center\ surface}$ minus $H_{center}$ is within a range having a lower limit of 0 or −1 or −3 or −5 or −7 or −10 or −13 and an upper limit of −13 or −15 or −20 or −25 or −30 or −33 or −35. In another particular embodiment, the center has a zero or positive hardness gradient, such that $H_{center\ surface}\geq H_{center}$. In a particular aspect of this embodiment, the value of $H_{center\ surface}$ minus $H_{center}$ is ≥0 or ≥1 or ≥3 or ≥5 or ≥6 or ≥8 or ≥10 or ≥13 or ≥15 or is within a range having a lower limit of 0 or 1 or 3 or 5 or 6 or 8 or 10 or 13 or 15 and an upper limit of 13 or 15 or 20 or 25 or 30 or 35 or 40, wherein the upper limit is greater than the lower limit (e.g., when the lower limit is 15, the upper limit is 20, 25, 30, 35, or 40).

The center has a compression of 90 or less, or 80 or less, or 70 or less, or 60 or less, or 50 or less, or 40 or less, or 20 or less; or a compression within a range having a lower limit of 10 or 20 or 30 or 35 or 40 or 50 or 60 and an upper limit of 40 or 50 or 60 or 70 or 80 or 90, wherein the upper limit is greater than the lower limit (e.g., when the lower limit is 50, the upper limit is 60, 70, 80 or 90).

The intermediate core layer has a thickness within a range having a lower limit of 0.005 or 0.010 or 0.020 or 0.025 or 0.035 or 0.040 or 0.045 inches and an upper limit of 0.045 or 0.050 0.060 or 0.070 or 0.080 or 0.090 or 0.100 inches.

The intermediate core layer has an outer surface Shore C hardness ($H_{intermediate}$) of 95 or less, or 90 or less, or 85 or less, or 80 or less, or 75 or less, or 70 or less, or an outer surface Shore C hardness ($H_{intermediate}$) within a range having a lower limit of 40 or 45 or 50 or 60 or 65 or 70 or 75 or 80 and an upper limit of 70 or 75 or 80 or 85 or 90 or 95, wherein the upper limit is greater than the lower limit (e.g., when the lower limit is 75, the upper limit is 80, 85, 90 or 95). In a particular embodiment, the intermediate core layer has a Shore D outer surface hardness within a range having a lower limit of 40 or 45 or 50 or 55 or 57 or 58 and an upper limit of 60 or 65 or 66 or 70 or 72 or 75 or 80.

In a particular embodiment, $H_{intermediate}$ is less than $H_{center}$. In a particular aspect of this embodiment, $H_{intermediate}$ is also less than $H_{center\ surface}$. In another particular aspect of this embodiment, $H_{intermediate}\leq H_{outer\ core}$.

In a particular embodiment, a subassembly consisting of the center and the intermediate core layer has a compression of 70 or less, or 65 or less, or 60 or less, or 55 or less, or 50 or less, or 40 or less, or 20 or less; or a compression within a range having a lower limit of 10 or 20 or 30 or 35 or 40 or 50 or 60 and an upper limit of 40 or 50 or 55 or 60 or 65 or 70 or 80 or 90, wherein the upper limit is greater than the lower limit (e.g., when the lower limit is 50, the upper limit is 55, 60, 65, 70, 80 or 90).

The outer core layer has a thickness within a range having a lower limit of 0.005 or 0.010 or 0.020 or 0.025 or 0.030 or 0.035 inches and an upper limit of 0.035 or 0.040 or 0.045 or 0.060 or 0.070 or 0.080 or 0.100 or 0.150 inches. In a particular embodiment, the outer core layer has a thickness of 0.035 inches or 0.040 inches or 0.045 inches or 0.050 inches or 0.055 inches or 0.060 inches or 0.065 inches.

The outer core layer has an outer surface Shore C hardness ($H_{outer\ core}$) of 25 or greater, or 45 or greater, or 60 or greater, or 70 or greater, or 75 or greater, or 80 or greater, or 85 or greater, or 90 or greater, or an outer surface Shore C hardness ($H_{outer\ core}$) within a range having a lower limit of 20 or 25 or 30 or 35 or 40 or 45 or 50 or 55 or 60 or 65 or 70 or 80 or 82 or 85 and an upper limit of 60 or 70 or 75 or 80 or 82 or 85 or 90 or 92 or 93 or 95, wherein the upper limit is greater than the lower limit (e.g., when the lower limit is 70, the upper limit is 75, 80, 82, 85, 90, 92, 93, or 95). The outer core layer preferably has a Shore D outer surface hardness within a range having a lower limit of 40 or 45 or 50 or 53 or 55 or 57 or 58 and an upper limit of 60 or 62 or 64 or 65 or 66 or 70.

In a particular embodiment, the overall core has a zero hardness gradient, such that $H_{center}=H_{outer\ core}$.

In another particular embodiment, the overall core has a negative hardness gradient, such that $H_{outer\ core}<H_{center}$. In a particular aspect of this embodiment, the value of $H_{outer\ core}$ minus $H_{center}$ is within a range having a lower limit of −1 or −3 or −5 or −7 and an upper limit of −10 or −13 or −15 or −20 or −25.

In another particular embodiment, the overall core has a positive hardness gradient, such that $H_{center}<H_{outer\ core}$. In a particular aspect of this embodiment, the value of $H_{outer\ core}$ minus $H_{center}$ is within a range having a lower limit of 1 or 3 or 5 or 7 and an upper limit of 10 or 15 or 20. In another particular aspect of this embodiment, the value of $H_{outer\ core}$ minus $H_{center}$ is within a range having a lower limit of 1 or 3 or 5 or 7 or 9 or 10 or 11 or 12 and the upper limit is 13 or 15 or 20 or 25 or 30 or 35.

In another particular embodiment, the overall core has a hardness gradient wherein the value of $H_{outer\ core}$ minus $H_{center}$ is ≤25 or ≤20 or ≤15 or ≤13 or ≤10 or ≤5 or ≤0, or the value of $H_{outer\ core}$ minus $H_{center}$ is within a range having a lower limit of −25 or −20 or −15 or −13 or −10 or −5 or 0 and an upper limit of 0 or 5 or 10 or 15 or 20 or 22 or 40.

Each core layer composition is independently selected from rubber and non-rubber compositions. Suitable rubber compositions for forming the core layers comprise a base rubber, an initiator agent, a coagent, and optionally one or more of a zinc oxide, zinc stearate or stearic acid, antioxidant, and soft and fast agent. Suitable base rubbers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isoprene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof (e.g., polybutadiene combined with lesser amounts of other thermoset materials selected from cis-polyisoprene, trans-polyisoprene, balata, polychloroprene, polynorbornene, polyoctenamer, polypentenamer, butyl rubber, EPR, EPDM, styrene-butadiene, and similar thermoset materials). Diene rubbers are preferred, particularly polybutadiene (including 1,4-polybutadiene having a cis-structure of at least 40%), styrene-butadiene, and mixtures of polybutadiene with other elastomers wherein the amount of polybutadiene present is at least 40 wt % based on the total polymeric weight of the mixture. Particularly preferred polybutadienes include high-cis neodymium-catalyzed polybutadienes and cobalt-, nickel-, or lithium-catalyzed polybutadienes. Suitable examples of commercially available polybutadienes include, but are not limited to, Buna CB high-cis neodymium-catalyzed polybutadiene rubbers, such as Buna CB 23, and Taktene® high-cis cobalt-catalyzed polybutadiene rubbers, such as Taktene® 220 and 221, commercially available from LANXESS® Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; and Neodene high-cis neodymium-catalyzed polybutadiene rubbers, such as Neodene BR 40, commercially available from Karbochem.

Suitable initiator agents include organic peroxides, high energy radiation sources capable of generating free radicals, and combinations thereof. High energy radiation sources capable of generating free radicals include, but are not limited to, electron beams, ultra-violet radiation, gamma radiation, X-ray radiation, infrared radiation, heat, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; lauryl peroxide; benzoyl peroxide; and combinations thereof. Examples of suitable commercially available peroxides include, but are not limited to Perkadox® BC dicumyl peroxide, commercially available from Akzo Nobel, and Varox® peroxides, such as Varox® ANS benzoyl peroxide, Varox® 231 1,1-di(t-butylperoxy)3,3,5-trimethylcyclohexane, and Varox® 230-XL n-butyl-4,4-bis(tert-butylperoxy)valerate, commercially available from RT Vanderbilt Company, Inc. Peroxide initiator agents are generally present in the rubber composition in an amount of at least 0.05 parts by weight per 100 parts of the base rubber, or an amount within the range having a lower limit of 0.05 parts or 0.1 parts or 0.8 parts or 1 part or 1.25 parts or 1.5 parts by weight per 100 parts of the base rubber, and an upper limit of 2.5 parts or 3 parts or 5 parts or 6 parts or 10 parts or 15 parts by weight per 100 parts of the base rubber.

Coagents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the coagent is selected from zinc salts of acrylates, diacrylates, methacrylates, dimethacrylates, and mixtures thereof. In another particular embodiment, the coagent is zinc diacrylate. When the coagent is zinc diacrylate and/or zinc dimethacrylate, the coagent is typically included in the rubber composition in an amount within the range having a lower limit of 1 or 5 or 10 or 15 or 19 or 20 parts by weight per 100 parts of the base rubber, and an upper limit of 24 or 25 or 30 or 35 or 40 or 45 or 50 or 60 parts by weight per 100 parts of the base rubber. When one or more less active coagents are used, such as zinc monomethacrylate and various liquid acrylates and methacrylates, the amount of less active coagent used may be the same as or higher than for zinc diacrylate and zinc dimethacrylate coagents. The desired compression may be obtained by adjusting the amount of crosslinking, which can be achieved, for example, by altering the type and amount of coagent.

The rubber composition optionally includes a curing agent. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may also contain one or more fillers to adjust the density and/or specific gravity of the core. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), metal oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers, and combinations of two or more thereof. The amount of particulate material(s) present in the rubber composition is typically within a range having a lower limit of 5 parts or 10 parts by weight per 100 parts of the base rubber, and an upper limit of 30 parts or 50 parts or 100 parts by weight per 100 parts of the base rubber. Filler materials may be dual-functional fillers, such as zinc oxide (which may be used as a filler/acid scavenger) and titanium dioxide (which may be used as a filler/brightener material).

The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like. The amount of additive(s) typically present in the rubber composition is typically within a range having a lower limit of 0 parts by weight per 100 parts of the base rubber, and an upper limit of 20 parts or 50 parts or 100 parts or 150 parts by weight per 100 parts of the base rubber.

The rubber composition optionally includes a soft and fast agent. Preferably, the rubber composition contains from 0.05 phr to 10.00 phr of a soft and fast agent. In one embodiment, the soft and fast agent is present in an amount within a range having a lower limit of 0.05 or 0.10 or 0.20 or 0.50 phr and an upper limit of 1.00 or 2.00 or 3.00 or 5.00 phr. In another embodiment, the soft and fast agent is present in an amount within a range having a lower limit of 2.00 or 2.35 phr and an upper limit of 3.00 or 4.00 or 5.00 phr. In an alternative high concentration embodiment, the soft and fast agent is present in an amount within a range having a lower limit of 5.00 or 6.00 or 7.00 phr and an upper limit of 8.00 or 9.00 or 10.00 phr. In another embodiment, the soft and fast agent is present in an amount of 2.6 phr.

Suitable soft and fast agents include, but are not limited to, organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof.

As used herein, "organosulfur compound" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Particularly suitable as soft and fast agents are organosulfur compounds having the following general formula:

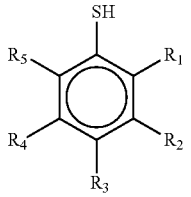

where $R_1$-$R_5$ can be $C_1$-$C_8$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; zinc salts thereof; non-metal salts thereof, for example, ammonium salt of pentachlorothiophenol; magnesium pentachlorothiophenol; cobalt pentachlorothiophenol; and combinations thereof. Preferably, the halogenated thiophenol compound is pentachlorothiophenol, which is commercially available in neat form or under the tradename STRUK- TOL® A95, a clay-based carrier containing the sulfur compound pentachlorothiophenol loaded at 45 percent. STRUKTOL® A95 is commercially available from Struktol Company of America of Stow, Ohio. PCTP is commercially available in neat form from eChinachem of San Francisco, Calif. and in the salt form from eChinachem of San Francisco, Calif. Most preferably, the halogenated thiophenol compound is the zinc salt of pentachlorothiophenol, which is commercially available from eChinachem of San Francisco, Calif. Suitable organosulfur compounds are further disclosed, for example, in U.S. Pat. Nos. 6,635,716, 6,919,393, 7,005,479 and 7,148,279, the entire disclosures of which are hereby incorporated herein by reference.

Suitable metal-containing organosulfur compounds include, but are not limited to, cadmium, copper, lead, and tellurium analogs of diethyldithiocarbamate, diamyldithiocarbamate, and dimethyldithiocarbamate, and combinations thereof. Additional examples are disclosed in U.S. Pat. No. 7,005,479, the entire disclosure of which is hereby incorporated herein by reference.

Suitable disulfides include, but are not limited to, 4,4'-diphenyl disulfide; 4,4'-ditolyl disulfide; 2,2'-benzamido diphenyl disulfide; bis(2-aminophenyl) disulfide; bis(4-aminophenyl) disulfide; bis(3-aminophenyl) disulfide; 2,2'-bis(4-aminonaphthyl) disulfide; 2,2'-bis(3-aminonaphthyl) disulfide; 2,2'-bis(4-aminonaphthyl) disulfide; 2,2'-bis(5-aminonaphthyl) disulfide; 2,2'-bis(6-aminonaphthyl) disulfide; 2,2'-bis(7-aminonaphthyl) disulfide; 2,2'-bis(8-aminonaphthyl) disulfide; 1,1'-bis(2-aminonaphthyl) disulfide; 1,1'-bis(3-aminonaphthyl) disulfide; 1,1'-bis(3-aminonaphthyl) disulfide; 1,1'-bis(4-aminonaphthyl) disulfide; 1,1'-bis(5-aminonaphthyl) disulfide; 1,1'-bis(6-aminonaphthyl) disulfide; 1,1'-bis(7-aminonaphthyl) disulfide; 1,1'-bis(8-aminonaphthyl) disulfide; 1,2'-diamino-1,2'-dithiodinaphthalene; 2,3'-diamino-1,2'-dithiodinaphthalene; bis(4-chlorophenyl) disulfide; bis(2-chlorophenyl) disulfide; bis(3-chlorophenyl) disulfide; bis(4-bromophenyl) disulfide; bis(2-bromophenyl) disulfide; bis(3-bromophenyl) disulfide; bis(4-fluorophenyl) disulfide; bis(4-iodophenyl) disulfide; bis(2,5-dichlorophenyl) disulfide; bis(3,5-dichlorophenyl) disulfide; bis(2,4-dichlorophenyl) disulfide; bis(2,6-dichlorophenyl) disulfide; bis(2,5-dibromophenyl) disulfide; bis(3,5-dibromophenyl) disulfide; bis(2-chloro-5-bromophenyl) disulfide; bis(2,4,6-trichlorophenyl) disulfide; bis(2,3,4,5,6-pentachlorophenyl) disulfide; bis(4-cyanophenyl) disulfide; bis(2-cyanophenyl) disulfide; bis(4-nitrophenyl) disulfide; bis(2-nitrophenyl) disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl) disulfide; bis(2-acetylphenyl) disulfide; bis(4-formylphenyl) disulfide; bis(4-carbamoylphenyl) disulfide; 1,1'-dinaphthyl disulfide; 2,2'-dinaphthyl disulfide; 1,2'-dinaphthyl disulfide; 2,2'-bis(1-chlorodinaphthyl) disulfide; 2,2'-bis(1-bromonaphthyl) disulfide; 1,1'-bis(2-chloronaphthyl) disulfide; 2,2'-bis(1-cyanonaphthyl) disulfide; 2,2'-bis(1-acetylnaphthyl) disulfide; and the like; and combinations thereof.

Suitable inorganic sulfide compounds include, but are not limited to, titanium sulfide, manganese sulfide, and sulfide analogs of iron, calcium, cobalt, molybdenum, tungsten, copper, selenium, yttrium, zinc, tin, and bismuth.

Suitable Group VIA compounds include, but are not limited to, elemental sulfur and polymeric sulfur, such as those which are commercially available from Elastochem, Inc. of Chardon, Ohio; sulfur catalyst compounds which include PB(RM-S)-80 elemental sulfur and PB(CRST)-65 polymeric sulfur, each of which is available from Elastochem, Inc; tellurium catalysts, such as TELLOY®, and selenium catalysts, such as VANDEX®, each of which is commercially available from RT Vanderbilt Company, Inc.

Suitable substituted and unsubstituted aromatic organic components that do not include sulfur or a metal include, but are not limited to, 4,4'-diphenyl acetylene, azobenzene, and combinations thereof. The aromatic organic group preferably ranges in size from $C_6$ to $C_{20}$, and more preferably from $C_6$ to $C_{10}$.

Suitable substituted and unsubstituted aromatic organometallic compounds include, but are not limited to, those having the formula $(R_1)_x$—$R_3$-M-$R_4$—$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_6$ to $C_{24}$ aromatic group; x and y are each an integer from 0 to 5; $R_3$ and $R_4$ are each selected from a single, multiple, or fused ring $C_6$ to $C_{24}$ aromatic group; and M includes an azo group or a metal component. Preferably, $R_3$ and $R_4$ are each selected from a $C_6$ to $C_{10}$ aromatic group, more preferably selected from phenyl, benzyl, naphthyl, benzamido, and benzothiazyl. Preferably $R_1$ and $R_2$ are each selected from substituted and unsubstituted $C_{1-10}$ linear, branched, and cyclic alkyl, alkoxy, and alkylthio groups, and $C_6$ to $C_{10}$ aromatic groups. When $R_1$, $R_2$, $R_3$, and $R_4$ are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl and sulfonamide; and phosphates and phosphites. When M is a metal component, it may be any suitable elemental metal. The metal is generally a transition metal, and is preferably tellurium or selenium.

Suitable hydroquinones are further disclosed, for example, in U.S. Patent Application Publication No. 2007/0213440, the entire disclosure of which is hereby incorporated herein by reference. Suitable benzoquinones are further disclosed, for example, in U.S. Patent Application Publication No. 2007/0213442, the entire disclosure of which is hereby incorporated herein by reference. Suitable quinhydrones are further disclosed, for example, in U.S. Patent Application Publication No. 2007/0213441, the entire disclosure of which is hereby incorporated herein by reference. Suitable catechols are further disclosed, for example, in U.S. Patent Application Publication No. 2007/0213144, the entire disclosure of which is hereby incorporated herein by reference. Suitable resorcinols are further disclosed, for example, in U.S. Patent Application Publication No. 2007/0213144, the entire disclosure of which is hereby incorporated herein by reference. When the rubber composition includes one or more hydroquinones, benzoquinones, quinhydrones, catechols, resorcinols, or a combination thereof, the total amount of hydroquinone(s), benzoquinone(s), quinhydrone(s), catechol(s), and/or resorcinol(s) present in the composition is typically at least 0.1 parts by weight or at least 0.15 parts by weight or at least 0.2 parts by weight per 100 parts of the base rubber, or an amount within the range having a lower limit of 0.1 parts or 0.15 parts or 0.25 parts or 0.3 parts or 0.375 parts by weight per 100 parts of the base rubber, and an upper limit of 0.5 parts or 1 part or 1.5 parts or 2 parts or 3 parts by weight per 100 parts of the base rubber.

In a particular embodiment, the soft and fast agent is selected from zinc pentachlorothiophenol, pentachlorothiophenol, ditolyl disulfide, diphenyl disulfide, dixylyl disulfide, 2-nitroresorcinol, and combinations thereof.

Suitable types and amounts of base rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

One or more of the core layers optionally comprises from 1 to 100 phr of a stiffening agent. In a particular embodiment, the intermediate core layer and/or the outer core layer comprises a stiffening agent. Suitable stiffening agents include, but are not limited to, ionomers, acid copolymers and terpolymers, polyamides, and polyesters. Stiffening agents are further disclosed, for example, in U.S. Pat. Nos. 6,120,390 and 6,284,840, the entire disclosures of which are hereby incorporated herein by reference. A transpolyisoprene (e.g., TP-301 transpolyisoprene, commercially available from Kuraray Co., Ltd.) or transbutadiene rubber may also be added to increase stiffness to a core layer and/or improve cold-forming properties, which may improve processability by making it easier to mold outer core layer half-shells during the golf ball manufacturing process. When included in a core layer composition, the stiffening agent is preferably present in an amount of from 5 to 10 pph.

Suitable non-rubber compositions for forming the core layers include, but are not limited to, partially- and fully-neutralized ionomers and blends thereof, including blends of highly neutralized polymers ("HNPs") with partially neutralized ionomers (as disclosed, for example, in U.S. Application Publication No. 2006/0128904), blends of HNPs with additional thermoplastic and thermoset materials, including, but not limited to, acid copolymers, engineering thermoplastics, fatty acid/salt-based HNPs, polybutadienes, polyurethanes, polyureas, polyesters, thermoplastic elastomers, other conventional polymer materials, and particularly the ionomer compositions disclosed, for example, in U.S. Pat. Nos. 6,653,382, 6,756,436, 6,777,472, 6,894,098, 6,919,393, and 6,953,820; graft copolymers of ionomer and polyamide; and the following non-ionomeric polymers, including homopolymers and copolymers thereof, as well as their derivatives that are compatibilized with at least one grafted or copolymerized functional group, such as maleic anhydride, amine, epoxy, isocyanate, hydroxyl, sulfonate, phosphonate, and the like: polyesters, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly(ethylene naphthenate), and those disclosed in U.S. Pat. Nos. 6,353,050, 6,274,298, and 6,001,930, and blends of two or more thereof; polyamides, polyamide-ethers, and polyamide-esters, and those disclosed in U.S. Pat. Nos. 6,187,864, 6,001,930, and 5,981,654, and blends of two or more thereof; thermosetting and thermoplastic polyurethanes, polyureas, polyurethane-polyurea hybrids, and blends of two or more thereof; fluoropolymers, such as those disclosed in U.S. Pat. Nos. 5,691,066, 6,747,110 and 7,009,002, and blends of two or more thereof; non-ionomeric acid polymers, such as E/Y- and E/X/Y-type copolymers, wherein E is an olefin (e.g., ethylene), Y is a carboxylic acid such as acrylic, methacrylic, crotonic, maleic, fumaric, or itaconic acid, and X is a softening comonomer such as vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons; and blends of two or more thereof; metallocene-catalyzed polymers, such as those disclosed in U.S. Pat. Nos. 6,274,669, 5,919,862, 5,981,654, and 5,703,166, and blends of two or more thereof; polystyrenes, such as poly(styrene-co-maleic anhydride), acrylonitrile-butadiene-styrene, poly(styrene sulfonate), polyethylene styrene, and blends of two or more thereof; polypropylenes and polyethylenes, particularly grafted polypropylene and grafted polyethylenes that are modified with a functional group, such as maleic anhydride of sulfonate, and blends of two or more thereof; polyvinyl chlorides and grafted polyvinyl chlorides, and blends of two or more thereof; polyvinyl acetates, preferably having less than about 9% of vinyl acetate by weight, and blends of two or more thereof; polycarbonates, blends of polycarbonate/acrylonitrile-butadiene-styrene, blends of polycarbonate/polyurethane, blends of polycarbonate/polyester, and blends of two or more thereof; polyvinyl alcohols, and blends of two or more thereof; polyethers, such as polyarylene ethers, polyphenylene oxides, block copolymers of alkenyl aromatics with vinyl aromatics and poly(amic ester)s, and blends of two or more thereof; polyimides, polyetherketones, polyamideimides, and blends of two or more thereof; polycarbonate/polyester copolymers and blends; and combinations of any two or more of the above polymers. Also suitable are the thermoplastic compositions disclosed in U.S. Pat. Nos. 5,919,100, 6,872,774 and 7,074,137. The entire disclosure of each of the above references is hereby incorporated herein by reference.

Particularly suitable for forming core layers of the present invention are ionomer compositions comprising an acid copolymer, a fatty acid or metal salt thereof, and, optionally, an additional cation source. Suitable acid copolymers are O/X- and O/X/Y-type acid copolymers, where O is ethylene or propylene, X is an $\alpha,\beta$-unsaturated carboxylic acid, and Y is an acrylate selected from alkyl acrylates and aryl acrylates; a combination of two or more thereof; or a metal salt thereof. Suitable fatty acids and metal salts thereof include, but are not limited to, caproic acid, caprylic acid, capric acid, lauric acid, stearic acid, behenic acid, erucic acid, oleic acid, linoleic acid, and the salts, particularly the magnesium, sodium, potassium, zinc, lithium, calcium, barium, bismuth, cesium, chromium, cobalt, copper, strontium, titanium, tungsten, manganese, tin, and rare earth metal salts thereof. The optional additional cation source is preferably selected from metal ions and compounds of alkali metals, alkaline earth metals, and transition metals; metal ions and compounds of rare earth elements; silicone, silane, and silicate derivatives and complex ligands; and combinations thereof; and more preferably selected from metal ions and compounds of magnesium, sodium, potassium, zinc, lithium, calcium, barium, bismuth, cesium, chromium, cobalt, copper, strontium, titanium, tungsten, manganese, tin, and rare earth metals. Preferably, at least 50%, or at least 60%, or at least 65%, or at least 70%, or at least 75%, or at least 80%, or at least 90%, or at least 95%, or 100%, of all acid groups present in the ionomer composition are neutralized. The ionomer composition optionally includes additives and fillers. Suitable additives and fillers include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers.

Examples of suitable commercially available thermoplastics for forming the core layers include, but are not limited to, Pebax® thermoplastic polyether block amides, commercially available from Arkema Inc.; Surlyn® ionomer resins, Hytrel® thermoplastic polyester elastomers, and ionomeric materials sold under the trade names DuPont® HPF 1000 and HPF 2000, all of which are commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; Clarix® ionomer resins, commercially available from A. Schulman Inc.; Elastollan® polyurethane-based thermoplastic elastomers, commercially available from BASF; and Xylex® polycarbonate/polyester blends, commercially available from SABIC Innovative Plastics. The thermoplastic composition may be treated or admixed with a thermoset diene composition to reduce or prevent flow upon overmolding. Optional treatments may also include the addition of peroxide to the material prior to molding, or a post-molding treatment with, for example, a crosslinking solution, electron beam, gamma radiation, isocyanate or amine solution treatment, or the like. Such treatments may prevent the intermediate layer from melting and flowing or "leaking" out at the mold equator, as the thermoset outer core layer is molded thereon at a temperature necessary to crosslink the outer core layer, which is typically from 280° F. to 360° F. for a period of about 5 to 30 minutes.

In addition to the above rubber and thermoplastic materials, the center can be formed from a low deformation material selected from metal, rigid plastics, polymers reinforced with high strength organic or inorganic fillers or fibers, and blends and composites thereof. Suitable low deformation materials also include those disclosed in U.S. Patent Application Publication No. 2005/0250600, the entire disclosure of which is hereby incorporated herein by reference.

Additional materials suitable for forming the core layers include the core compositions disclosed in U.S. Pat. No. 7,300,364, the entire disclosure of which is hereby incorporated herein by reference. For example, any one or more of the core layers may be formed from a composition comprising an HNP neutralized with organic fatty acids and salts thereof, metal cations, or a combination of both. In addition to HNPs neutralized with organic fatty acids and salts thereof, core compositions may comprise at least one rubber material having a resilience index of at least about 40. Preferably the resilience index is at least about 50. Polymers that produce resilient golf balls and, therefore, are suitable for the present invention, include but are not limited to CB23, CB22, commercially available from LANXESS® Corporation, BR60, commercially available from Enichem, and 1207G, commercially available from Goodyear Corp. Additionally, the unvulcanized rubber, such as polybutadiene, in golf balls prepared according to the invention typically has a Mooney viscosity, as measured according to ASTM-D1646, within a range having a lower limit of 40 or 45 and an upper limit of 55 or 65 or 80.

Each of the core layers has a specific gravity within a range having a lower limit of 0.50 or 0.90 or 0.95 or 0.99 or 1.00 or 1.05 or 1.09 or 1.10 or 1.11 or 1.12 or 1.13 g/cc and an upper limit of 1.15 or 1.17 or 1.18 or 1.19 or 1.25 or 1.30 or 1.40 or 1.50 or 5.00 g/cc, or a specific gravity of 1.25 g/cc or less, or 1.20 g/cc or less, or 1.18 g/cc or less, or 1.15 g/cc or less.

In a particular embodiment, the specific gravity of the outer core layer is within 0.01 g/cc of the specific gravity of the intermediate core layer.

In another particular embodiment, the specific gravity of the outer core layer is within 0.01 g/cc of the specific gravity of the intermediate core layer, and is also within 0.01 g/cc of the specific gravity of the center.

In another particular embodiment, the specific gravity of the outer core layer is greater than the specific gravity of the intermediate core layer and the specific gravity of the center. In a particular aspect of this embodiment, the outer core layer is formed from a thin dense layer composition. Thin dense layer compositions include those disclosed, for example, in U.S. Pat. No. 6,494,795, the entire disclosure of which is hereby incorporated herein by reference. Also suitable for use as thin dense layer compositions are the thermoplastic materials disclosed in U.S. Pat. Nos. 6,149,535 and 6,152,834, the entire disclosure of which is hereby incorporated herein by reference. In another particular aspect of this embodiment, the outer core layer is a thin dense layer having a specific gravity of 1.2 or greater, or 1.5 or greater, or 1.8 or greater, or 2 or greater, and a thickness within the range having a lower limit of 0.001 or 0.005 or 0.010 or 0.020 inches and an upper limit of 0.020 or 0.030 or 0.035 or 0.045 or 0.050 or 0.060 inches. The thin dense layer is preferably applied as a liquid solution, dispersion, lacquer, paste, gel, melt, etc., such as a loaded or filled natural or non-natural rubber latex, polyurethane, polyurea, epoxy, polyester, any reactive or non-reactive coating or casting material; and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of from 0.021 inches to 0.025 inches, a specific gravity of 1.31, and a Shore C hardness of about 72. For reactive liquid systems, the suitable materials include any material which reacts to form a solid such as epoxies, styrenated polyesters, polyurethanes or polyureas, liquid polybutadienes, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Thin dense layers are more fully disclosed in U.S. Patent Application Publication No. 2005/0059510, the entire disclosure of which is hereby incorporated herein by reference.

The weight distribution of cores disclosed herein can be varied to achieve certain desired parameters, such as spin rate, compression, and initial velocity.

Golf ball cores of the present invention typically have a coefficient of restitution at 125 ft/s ("COR") of 0.750 or greater, or 0.775 or greater, or 0.780 or greater, or 0.782 or greater, or 0.785 or greater, or 0.787 or greater, or 0.790 or greater, or 0.795 or greater, or 0.798 or greater, or 0.800 or greater, or 0.810 or greater, or 0.820 or greater, or 0.830 or greater, or 0.840 or greater, or 0.850 or greater.

Golf ball cores of the present invention typically have an overall core compression within a range having a lower limit of 40 or 60 or 70 or 80 or 85 or 90 and an upper limit of 100 or 105 or 110 or 115.

The multi-layer core is enclosed with a cover, which may be a single-, dual-, or multi-layer cover having an overall thickness within a range having a lower limit of 0.010 or 0.015 or 0.020 or 0.025 or 0.030 or 0.040 or 0.045 inches and an upper limit of 0.030 or 0.040 or 0.045 or 0.050 or 0.055 or 0.060 or 0.070 or 0.075 or 0.080 or 0.090 or 0.100 or 0.120 or 0.140 or 0.150 or 0.200 or 0.300 or 0.500 inches, where the upper limit is greater than the lower limit (e.g., when the lower limit is 0.040, the upper limit is 0.045, 0.050, 0.055, 0.060, 0.070, 0.075, 0.080, 0.090, 0.100, 0.120, 0.140, 0.150, 0.200, 0.300, or 0.500).

In a particular embodiment, the cover is a single layer having a thickness within a range having a lower limit of 0.010 or 0.015 or 0.020 or 0.025 or 0.027 or 0.029 or 0.030 inches and an upper limit of 0.030 or 0.033 or 0.034 or 0.035 or 0.040 or 0.050 or 0.055 or 0.100 or 0.120 or 0.140 inches, and an outer surface hardness of 70 Shore D or less, or 65 Shore D or less, or 60 Shore D or less, or an outer surface within a range having a lower limit of 20 or 30 or 35 or 40 or 45 or 50 or 55 or 58 Shore D and an upper limit of 55 or 58 or 60 or 63 or 65 or 70 Shore D, wherein the upper limit is greater than the lower limit (e.g., when the lower limit is 58 Shore D, the upper limit is 60 or 65 or 70 Shore D).

In another particular embodiment the cover comprises an inner cover layer and an outer cover layer. In a particular aspect of this embodiment, the inner cover layer has a material hardness of 95 Shore C or less, or less than 95 Shore C, or 92 Shore C or less, or 90 Shore C or less, or has a material hardness within a range having a lower limit of 70 or 75 or 80 or 84 or 85 Shore C and an upper limit of 90 or 92 or 95 Shore C, and a thickness within a range having a lower limit of 0.010 or 0.015 or 0.020 or 0.030 inches and an upper limit of 0.035 or 0.045 or 0.080 or 0.120 inches. In another particular aspect of this embodiment, the outer cover layer has a material hardness of 85 Shore C or less, and a thickness within a range having a lower limit of 0.010 or 0.015 or 0.025 inches and an upper limit of 0.035 or 0.040 or 0.055 or 0.080 inches.

In another particular embodiment, the cover comprises an inner cover layer and an outer cover layer, wherein the inner cover layer, preferably formed from a partially or fully neutralized ionomer composition, has an outer surface hardness of 60 Shore D or greater, or 63 Shore D or greater, or 65 Shore D or greater, and a thickness within a range having a lower limit of 0.010 or 0.020 or 0.030 or 0.035 inches and an upper limit of 0.040 or 0.045 or 0.080 or 0.120 inches, and wherein the outer cover layer, preferably formed from a polyurethane, polyurea, or blend or copolymer of polyurethane and polyurea, has an outer surface hardness of 60 Shore D or less, or 55 Shore D or less, or 50 Shore D or less, or an outer surface hardness within a range having a lower limit of 20 or 30 or 35 Shore D and an upper limit of 50 or 55 or 60 or 63 or 65 or 70 Shore D, and a thickness within a range having a lower limit of 0.010 or 0.015 or 0.025 or 0.030 inches and an upper limit of 0.030 or 0.035 or 0.040 or 0.045 or 0.055 or 0.080 inches.

In another particular embodiment, the cover comprises an inner cover layer and an outer cover layer, wherein the inner cover layer is preferably formed from a composition having a material hardness of 60 Shore D or greater, or 63 Shore D or greater, or 65 Shore D or greater, and the outer cover layer is preferably formed from a composition having a material hardness of 65 Shore D or less, or 63 Shore D or less, or 62 Shore D or less, or 60 Shore D or less or a material hardness within a range having a lower limit of 20 or 30 or 35 Shore D and an upper limit of 60 or 63 or 65 Shore D. In a particular aspect of this embodiment, the inner cover layer is formed from a partially or fully neutralized ionomer composition. In another particular aspect of this embodiment, the inner cover layer has a thickness within a range having a lower limit of 0.010 or 0.020 or 0.030 or 0.035 inches and an upper limit of 0.040 or 0.045 or 0.080 or 0.120 inches. In another particular aspect of this embodiment, the outer cover layer is formed from a polyurethane, polyurea, or blend or copolymer of polyurethane and polyurea. In another particular aspect of this embodiment, the outer cover layer has a thickness within a range having a lower limit of 0.010 or 0.015 or 0.025 or 0.030 inches and an upper limit of 0.030 or 0.035 or 0.040 or 0.055 or 0.080 inches. In another particular aspect of this embodiment, the outer surface hardness of the outer cover layer is less than the outer surface hardness of the inner cover layer.

Cover layer compositions preferably have a flexural modulus, as measured according to ASTM D6272-98 Procedure B, within a range having a lower limit of 5,000 or 12,000 psi and an upper limit of 24,000 or 50,000 psi.

Suitable cover materials include, but are not limited to, polyurethanes, polyureas, and hybrids of polyurethane and polyurea; ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof.

Polyurethanes, polyureas, and polyurethane-polyurea hybrids (i.e., blends and copolymers of polyurethanes and polyureas) are particularly suitable for forming cover layers of the present invention. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions of the present invention include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, i.e., as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy) ethoxy]benzene; 1,3-bis-{2-[2-(2-hydroxyethoxy) ethoxy] ethoxy}benzene; 1,4-butanediol; 1,5-pentanediol; 1,6-hexanediol; resorcinol-di-(β-hydroxyethyl) ether; hydroquinone-di-(β-hydroxyethyl) ether; trimethylol propane; and combinations thereof.

Suitable polyurethane cover compositions of the present invention also include those formed from the reaction product of at least one isocyanate and at least one curing agent or the reaction produce of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p, p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The present invention is not limited by the use of a particular polyisocyanate in the cover composition. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), toluene diisocyanate ("TDI"), 3,3'-dimethyl-4,4'-biphenylene diisocyanate ("TODI"), isophoronediisocyanate ("HMI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than 14% unreacted NCO groups. Preferably, the at least one polyisocyanate has no greater than 8.5% NCO, more preferably from 2.5% to 8.0%, even more preferably from 4.0% to 7.2%, and most preferably from 5.0% to 6.5%.

The present invention is not limited by the use of a particular polyol in the cover composition. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent of the present invention includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(4-hydroxyethyl) ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Compositions comprising an ionomer or a blend of two or more ionomers are also particularly suitable for forming cover layers. Preferred ionomeric cover compositions include:

(a) a composition comprising a "high acid ionomer" (i.e., having an acid content of greater than 16 wt %), such as Surlyn 8150®;

(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, Surlyn® 9150, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® polymers, and Nucrel® copolymers are commercially available from E. I. du Pont de Nemours and Company.

Ionomeric cover compositions can be blended with non-ionic thermoplastic resins, particularly to manipulate product properties. Examples of suitable non-ionic thermoplastic resins include, but are not limited to, polyurethane, polyether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, plyethylene-(meth)acrylic acid, functionalized polymers with maleic anhydride grafting, Fusabond® functionalized polymers commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Ionomer golf ball cover compositions may include a flow modifier, such as, but not limited to, Nucrel® acid copolymer resins, and particularly Nucrel® 960. Nucrel® acid copolymer resins are commercially available from E. I. du Pont de Nemours and Company.

Suitable ionomeric cover materials are further disclosed, for example, in U.S. Pat. Nos. 6,653,382, 6,756,436, 6,894,098, 6,919,393, and 6,953,820, the entire disclosures of which are hereby incorporated by reference.

Cover compositions may include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

In a particular embodiment, the cover is a single layer formed from a fully aliphatic polyurea. In another particular embodiment, the cover is a single layer formed from a polyurea composition, preferably selected from those disclosed in U.S. Patent Application Publication No. 2009/0011868, the entire disclosure of which is hereby incorporated herein by reference.

Suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

A moisture vapor barrier layer is optionally employed between the core and the cover. Moisture vapor barrier layers are further disclosed, for example, in U.S. Pat. Nos. 6,632,147, 6,838,028, 6,932,720, 7,004,854, and 7,182,702, and U.S. Patent Application Publication Nos. 2003/0069082, 2003/0069085, 2003/0130062, 2004/0147344, 2004/0185963, 2006/0068938, 2006/0128505 and 2007/0129172, the entire disclosures of which are hereby incorporated herein by reference.

One or more of the golf ball layers, other than the innermost and outermost layers, is optionally a non-uniform thickness layer. For purposes of the present disclosure, a "non-uniform thickness layer" refers to a layer having projections, webs, ribs, and the like, disposed thereon such that the thickness of the layer varies. The non-uniform thickness layer preferably has one or more of: a plurality of projections disposed thereon, a plurality of a longitudinal webs, a plurality of latitudinal webs, or a plurality of circumferential webs. In a particular embodiment, the non-uniform thickness layer comprises a plurality of projections disposed on the outer surface and/or inner surface thereof. The projections may be made integral with the layer or may be made separately and then attached to the layer. The projections may have any shape or profile including, but not limited to, trapezoidal, sinusoidal, dome, stepped, cylindrical, conical, truncated conical, rectangular, pyramidal with polygonal base, truncated pyramidal or polyhedronal. Suitable shapes and profiles for the inner and outer projections also include those disclosed in U.S. Pat. No. 6,293,877, the entire disclosure of which is hereby incorporated herein by reference. In another particular embodiment, the non-uniform thickness layer comprises a plurality of inner and/or outer circular webs disposed thereon. In a particular aspect of this embodiment, the presence of the webs increases the stiffness of the non-uniform thickness layer. The webs may be longitudinal webs, latitudinal webs, or circumferential webs.

Non-uniform thickness layers of golf balls of the present invention preferably have a thickness within a range having a lower limit of 0.010 or 0.015 inches to 0.100 or 0.150 inches, and preferably have a flexural modulus within a range having a lower limit of 5,000 or 10,000 psi and an upper limit of 80,000 or 90,000 psi.

Non-uniform thickness layers are further disclosed, for example, in U.S. Pat. No. 6,773,364 and U.S. Patent Application Publication No. 2008/0248898, the entire disclosures of which are hereby incorporated herein by reference.

In addition to the materials disclosed above, any of the core or cover layers may comprise one or more of the following materials: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, styrene-acrylonitrile (SAN), olefin-modified SAN, acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene rubber (EPDM), ethylene-vinyl acetate copolymer (EVA), ethylene propylene rubber (EPR), ethylene vinyl acetate, polyurea, and polysiloxane. Suitable polyamides for use as an additional material in compositions disclosed herein also include resins obtained by: (1) polycondensation of (a) a dicarboxylic acid, such as oxalic acid, adipic acid, sebacic acid, terephthalic acid, isophthalic acid or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; or (4) copolymerzation of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

Other preferred materials suitable for use as an additional material in golf ball compositions disclosed herein include Skypel polyester elastomers, commercially available from SK Chemicals of South Korea; Septon® diblock and triblock copolymers, commercially available from Kuraray Corporation of Kurashiki, Japan; and Kraton® diblock and triblock copolymers, commercially available from Kraton Polymers LLC of Houston, Tex.

Ionomers are also well suited for blending with compositions disclosed herein. Suitable ionomeric polymers include α-olefin/unsaturated carboxylic acid copolymer- or terpolymer-type ionomeric resins. Copolymeric ionomers are obtained by neutralizing at least a portion of the carboxylic groups in a copolymer of an α-olefin and an α,β-unsaturated carboxylic acid having from 3 to 8 carbon atoms, with a metal ion. Terpolymeric ionomers are obtained by neutralizing at least a portion of the carboxylic groups in a terpolymer of an α-olefin, an α,β-unsaturated carboxylic acid having from 3 to 8 carbon atoms, and an α,β-unsaturated carboxylate having from 2 to 22 carbon atoms, with a metal ion. Examples of suitable α-olefins for copolymeric and terpolymeric ionomers include ethylene, propylene, 1-butene, and 1-hexene. Examples of suitable unsaturated carboxylic acids for copolymeric and terpolymeric ionomers include acrylic, methacrylic, ethacrylic, α-chloroacrylic, crotonic, maleic, fumaric, and itaconic acid. Copolymeric and terpolymeric ionomers include ionomers having varied acid contents and degrees of acid neutralization, neutralized by monovalent or bivalent cations as disclosed herein. Examples of commercially available ionomers suitable for blending with compositions disclosed herein include Surlyn® ionomer resins, commercially available from E. I. du Pont de Nemours and Company, and Iotek® ionomers, commercially available from ExxonMobil Chemical Company.

Silicone materials are also well suited for blending with compositions disclosed herein. Suitable silicone materials include monomers, oligomers, prepolymers, and polymers, with or without adding reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl, and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl, and xylyl; aralkyl groups, such as benzyl and phenethyl; and halogenated alkyl groups, such as 3,3,3-trifluoropropyl and chloromethyl. Another type of suitable silicone material is one having hydrocarbon groups that lack aliphatic unsaturation. Specific examples include: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxyl-endblocked methylphenylsiloxane-dimethylsiloxane-methylvinysiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and the copolymers listed above wherein at least one group is dimethylhydroxysiloxy. Examples of commercially available silicones suitable for blending with compositions disclosed herein include Silastic® silicone rubber, commercially available from Dow Corning Corporation of Midland, Mich.; Blensil® silicone rubber, commercially available from General Electric Company of Waterford, N.Y.; and Elastosil® silicones, commercially available from Wacker Chemie AG of Germany.

Other types of copolymers can also be added to the golf ball compositions disclosed herein. For example, suitable copolymers comprising epoxy monomers include styrene-butadiene-styrene block copolymers in which the polybutadiene block contains an epoxy group, and styrene-isoprene-styrene block copolymers in which the polyisoprene block contains epoxy. Examples of commercially available epoxy functionalized copolymers include ESBS A1005, ESBS A1010, ESBS A1020, ESBS AT018, and ESBS AT019 epoxidized styrene-butadiene-styrene block copolymers, commercially available from Daicel Chemical Industries, Ltd. of Japan.

Ionomeric compositions used to form golf ball layers of the present invention can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, Pebax® thermoplastic polyether block amides commercially available from Arkema Inc., styrene-butadiene-styrene block copolymers, styrene(ethylene-butylene)-styrene block copolymers, polyamides, polyesters, polyolefins (e.g., polyethylene, polypropylene, ethylene-propylene copolymers, ethylene-(meth) acrylate, ethylene-(meth)acrylic acid, functionalized polymers with maleic anhydride grafting, epoxidation, etc., elastomers (e.g., EPDM, metallocene-catalyzed polyethylene) and ground powders of the thermoset elastomers.

Compositions disclosed herein can be either foamed or filled with density adjusting materials to provide desirable golf ball performance characteristics.

The present invention is not limited by any particular process for forming the golf ball layer(s). It should be understood that the layer(s) can be formed by any suitable technique, including injection molding, compression molding, casting, and reaction injection molding. In particular, a thin thermosetting layer may be formed by any conventional means for forming a thin layer of vulcanized or otherwise crosslinked rubber including, but not limited to, compression molding, rubber-injection molding, casting of a liquid rubber, and laminating.

When injection molding is used, the composition is typically in a pelletized or granulated form that can be easily fed into the throat of an injection molding machine wherein it is melted and conveyed via a screw in a heated barrel at temperatures of from 150° F. to 600° F., preferably from 200° F. to 500° F. The molten composition is ultimately injected into a closed mold cavity, which may be cooled, at ambient or at an elevated temperature, but typically the mold is cooled to a temperature of from 50° F. to 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

When compression molding is used to form a core, the composition is first formed into a preform or slug of material, typically in a cylindrical or roughly spherical shape at a weight slightly greater than the desired weight of the molded core. Prior to this step, the composition may be first extruded or otherwise melted and forced through a die after which it is cut into a cylindrical preform. The preform is then placed into a compression mold cavity and compressed at a mold temperature of from 150° F. to 400° F., preferably from 250° F. to 400° F., and more preferably from 300° F. to 400° F. When compression molding an outer layer, half-shells of the layer material are first formed via injection molding. A golf ball subassembly is then enclosed within two half-shells, which is then placed into a compression mold cavity and compressed.

Reaction injection molding processes are further disclosed, for example, in U.S. Pat. Nos. 6,083,119, 7,208,562, 7,281,997, 7,282,169, 7,338,391, and U.S. Patent Application Publication No. 2006/0247073, the entire disclosures of which are hereby incorporated herein by reference.

Thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. Patent Application Publication No. 2009/0020911 and U.S. Pat. Nos. 7,410,429, 7,429,221, 7,537,529, and 7,537,530, the entire disclosures of which are hereby incorporated herein by reference.

Golf balls of the present invention typically have a COR of 0.700 or greater, preferably 0.750 or greater, and more preferably 0.780 or greater. COR, as used herein, is determined according to a known procedure wherein a golf ball or golf ball subassembly (e.g., a golf ball core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{in}/V_{out}=T_{in}/T_{out}$.

Golf balls of the present invention typically have a compression of 40 or greater, or a compression within a range having a lower limit of 40 or 50 or 60 or 65 or 80 or 85 or 90 and an upper limit of 80 or 85 or 90 or 100 or 110 or 115 or 120, where the upper limit is greater than the lower limit (e.g., when the lower limit is 85, the upper limit is 90, 100, 110, 115, or 120).

Compression is an important factor in golf ball design. For example, the compression of the core can affect the ball's spin rate off the driver and the feel. As disclosed in Jeff Dalton's *Compression by Any Other Name, Science and Golf IV, Proceedings of the World Scientific Congress of Golf* (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

Golf balls of the present invention typically have dimple coverage of 60% or greater, preferably 65% or greater, and more preferably 75% or greater.

Golf balls of the present invention can have an overall diameter of any size. The preferred diameter of the present golf balls is within a range having a lower limit of 1.680 inches and an upper limit of 1.740 or 1.760 or 1.780 or 1.800 inches.

Golf balls of the present invention preferably have a moment of inertia ("MOT") of 70-95 $g \cdot cm^2$, preferably 75-93 $g \cdot cm^2$, and more preferably 76-90 $g \cdot cm^2$. For low MOT embodiments, the golf ball preferably has an MOT of 85 $g \cdot cm^2$ or less, or 83 $g \cdot cm^2$ or less. For high MOT embodiment, the golf ball preferably has an MOT of 86 $g \cdot cm^2$ or greater, or 87 $g \cdot cm^2$ or greater. MOT is measured on a model MOI-005-104 Moment of Inertia Instrument manufactured by Inertia Dynamics of Collinsville, Conn. The instrument is connected to a PC for communication via a COMM port and is driven by MOT Instrument Software version #1.2.

The surface hardness of a golf ball layer is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

Hardness points should only be measured once at any particular geometric location.

For purposes of the present disclosure, a hardness gradient of a center is defined by hardness measurements made at the outer surface of the center and the center point of the core. "Negative" and "positive" refer to the result of subtracting the hardness value at the innermost portion of the golf ball component from the hardness value at the outer surface of the component. For example, if the outer surface of a solid center has a lower hardness value than the center (i.e., the surface is softer than the center), the hardness gradient will be deemed a "negative" gradient. In measuring the hardness gradient of a center, the center hardness is first determined according to the procedure above for obtaining the center hardness of a core. Once the center of the core is marked and the hardness thereof is determined, hardness measurements at any distance from the center of the core may be measured by drawing a line radially outward from the center mark, and measuring and marking the distance from the center, typically in 2 mm increments. All hardness measurements performed on a plane passing through the geometric center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point, e.g., at the center of the core for a single, solid core, such that a core surface softer than its center will have a negative hardness gradient.

Hardness gradients are disclosed more fully, for example, in U.S. Pat. Nos. 7,427,242 and 7,429,221, and U.S. Patent Application Publication Nos. 2009/0124413, 2009/0124418, 2009/0124419, the entire disclosures of which are hereby incorporated herein by reference.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising a core and a cover, wherein the core has an overall diameter of from 1.40 inches to 1.62 inches and comprises:

a center having a diameter of from 0.100 inches to 0.950 inches, a center Shore C hardness ($H_{center}$) of 30 or greater, an outer surface Shore C hardness ($H_{center\ surface}$) of 20 or greater, wherein $H_{center\ surface} \leq H_{center}$;

an intermediate core layer having an outer surface Shore C hardness ($H_{intermediate}$) of 75 or less; and an outer core layer having an outer surface Shore C hardness ($H_{outer\ core}$) of from 40 to 95;

wherein $H_{outer\ core} - H_{center}$ is from 1 to 35.

2. The golf ball of claim 1, wherein $H_{outer\ core} - H_{center}$ is from 1 to 15.

3. The golf ball of claim 1, wherein $H_{outer\ core} - H_{center}$ is from 1 to 10.

4. The golf ball of claim 1, wherein the center is formed from a first rubber composition, the intermediate core layer is formed from a second rubber composition, and the outer core layer is formed from a third rubber composition.

5. The golf ball of claim 1, wherein the center is formed from a highly neutralized polymer composition, the intermediate core layer is formed from a first rubber composition, and the outer core layer is formed from a second rubber composition.

6. The golf ball of claim 1, wherein the center is formed from a first highly neutralized polymer composition, the intermediate core layer is formed from a second highly neutralized polymer composition, and the outer core layer is formed from a rubber composition.

7. The golf ball of claim 1, wherein the center is formed from a first highly neutralized polymer composition, the intermediate core layer is formed from a second highly neutralized polymer composition, and the outer core layer is formed from a third highly neutralized polymer composition.

8. The golf ball of claim 1, wherein the center is formed from a rubber composition, the intermediate core layer is formed from a first highly neutralized polymer composition, and the outer core layer is formed from a second highly neutralized polymer composition.

9. The golf ball of claim 1, wherein the center is formed from a first rubber composition, the intermediate core layer is formed from a second rubber composition, and the outer core layer is formed from a highly neutralized polymer composition.

* * * * *